US010308059B2

(12) United States Patent
Sano

(10) Patent No.: US 10,308,059 B2
(45) Date of Patent: Jun. 4, 2019

(54) PRINTING APPARATUS AND CONTROL METHOD FOR PRINTING APPARATUS

(71) Applicant: SEIKO EPSON CORPORATION, Tokyo (JP)

(72) Inventor: Tomohiko Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/833,460

(22) Filed: Dec. 6, 2017

(65) Prior Publication Data

US 2018/0154670 A1 Jun. 7, 2018

(30) Foreign Application Priority Data

Dec. 7, 2016 (JP) ..... 2016-237414

(51) Int. Cl.
*B41M 7/00* (2006.01)
*B41J 2/01* (2006.01)
*B41J 11/00* (2006.01)

(52) U.S. Cl.
CPC ..... *B41M 7/009* (2013.01); *B41J 2/01* (2013.01); *B41J 11/002* (2013.01)

(58) Field of Classification Search
CPC ..... B41M 7/009; B41J 2/01; B41J 11/002
USPC ..... 347/17
See application file for complete search history.

(56) References Cited

U.S. PATENT DOCUMENTS

2014/0225955 A1* 8/2014 Perez Gellida ..... B41J 11/002 347/17

FOREIGN PATENT DOCUMENTS

JP 11-115175 A 4/1999
JP 2009-066864 A 4/2009

* cited by examiner

*Primary Examiner* — Huan H Tran
*Assistant Examiner* — Alexander D Shenderov
(74) *Attorney, Agent, or Firm* — Foley & Lardner LLP

(57) ABSTRACT

A printing apparatus for performing printing on a medium includes a temperature sensor configured to detect temperature and a control unit configured to, in a case where an operation mode of the printing apparatus is a first mode, allow the temperature sensor to detect temperature of heat emitted by an external heater, and execute processing in relation to an adjustment of the external heater based on the detected temperature. The external heater is externally installed and is configured to heat the medium.

14 Claims, 9 Drawing Sheets

PRINTING APPARATUS AND CONTROL METHOD FOR PRINTING APPARATUS

BACKGROUND

1. Technical Field

The present invention relates to a printing apparatus and a control method for a printing apparatus.

2. Related Art

Heretofore, printing apparatuses each provided with one or more heaters for fixating inks have been known (see, for example, JP-A-11-115175). In JP-A-11-115175, there is disclosed a printing apparatus provided with a plurality of heaters and configured to allow the plurality of heaters to irradiate far-infrared rays to fixate inks having been ejected on recording paper that is a medium.

When a user uses a printing apparatus provided with one or more heaters, such as the printing apparatus disclosed in JP-A-11-115175, the user sometimes heats a medium using an external heater concurrently. In this case, in order to allow the printing apparatus to be appropriately performed, an appropriate adjustment of the installation position, the output, and the like of the external heater is required, but conventional adjustments of the external heater tend to depend on user's feeling, experiences, and the like, and thus, the adjustment of the external heater has sometimes not been facilitated.

SUMMARY

An advantage of some aspects of the invention is that a printing apparatus and a control method for a printing apparatus are provided that facilitate the adjustment of an external heater.

According to a first aspect of the invention, a printing apparatus for performing printing on a medium includes a temperature sensor configured to detect temperature and a control unit configured to, in a case where an operation mode of the printing apparatus is a first mode, allow the temperature sensor to detect temperature of heat emitted by an external heater, and execute processing in relation to an adjustment of the external heater based on the detected temperature. Here, the external heater is externally installed and is configured to heat the medium.

According to this configuration, processing in relation to the external heater is executed based on the temperature of the heat emitted by the external heater, which is detected by the temperature sensor, and thus, the adjustment of the external heater is facilitated.

Further, in the first aspect, the printing apparatus further includes a heater configured to heat the medium, and the temperature sensor is a temperature sensor configured to detect temperature of the heater.

According to this configuration, the temperature sensor configured to detect the heater included in the printing apparatus is used as the temperature sensor configured to detect the temperature of the heat emitted by the external heater, and thus, the adjustment of the external heater is facilitated without newly providing a temperature sensor.

Further, in the first aspect, the printing apparatus further includes a reporting unit configured to report information, and based on the temperature detected by the temperature sensor, the control unit allows the reporting unit to report information indicating whether or not the temperature of the heat emitted by the external heater is within an acceptable range.

According to this configuration, information indicating whether or not the temperature of the heat emitted by the external heater is within an acceptable range is reported by the reporting unit, and thus, a user is able to recognize whether or not the temperature of the heat emitted by the external heater is within an acceptable range, and the convenience for the user is increased.

Further, in the first aspect, the printing apparatus further includes an instructing unit configured to perform issuing of an instruction in relation to the adjustment of the external heater, and the control unit allows the instructing unit to perform issuing of an instruction for instructing at least any of an adjustment of an installation position of the external heater and an adjustment of an output of the external heater.

According to this configuration, issuing of an instruction for instructing at least any of the adjustment of the installation position of the external heater and the adjustment of the output of the external heater is performed, and thus, a user is able to easily adjust the external heater without depending on the feeling, experiences, and the like of the user.

Further, in the first aspect, based on the temperature detected by the temperature sensor, when the temperature of the sensor has risen above a predetermined threshold value, the control unit causes operation of the printing apparatus to be stopped.

According to this configuration, when the temperature of the heater included in the printing apparatus has risen above a predetermined value, the operation of the printing apparatus is caused to be stopped, and thus, the safety of the printing apparatus is ensured.

Further, in the first aspect, the control unit waits for a reception of an instruction indicating whether or not the operation mode of the printing apparatus is to be moved to a second mode based on the temperature detected by the temperature sensor, the second mode being a mode in which, even when the temperature of the heater has risen above the predetermined threshold value, the operation of the printing apparatus is not caused to be stopped. Further, upon reception of an instruction indicating that the operation mode of the printing apparatus is to be moved to the second mode, the control unit moves the operation mode of the printing apparatus to the second mode.

According to this configuration, in the case where an instruction indicating that the operation mode of the printing apparatus is to be moved to the second mode has been received, even when the temperature of the heater included in the printing apparatus has risen above a predetermined threshold value, the operation of the printing apparatus is not caused to be stopped. Thus, even when printing is performed while the external heater is concurrently used, the stop of the operation of the printing apparatus is prevented and the convenience for a user when the external heater is concurrently used is increased.

Further, in the first aspect, the printing apparatus further includes a power supply unit configured to supply electric power to the external heater, and the control unit controls the electric power supplied by the power supply unit based on the temperature detected by the temperature sensor.

According to this configuration, the electric power supplied by the power supply unit is controlled on the basis of the temperature detected by the temperature sensor, and thus, the control of the output of the external heater based on the temperature detected by the temperature sensor is achieved.

According to a second aspect of the invention, a control method for a printing apparatus for performing printing on a medium includes, in a case where an operation mode of the printing apparatus is a first mode, detecting, by a temperature sensor, temperature of heat emitted by an external heater externally installed and configured to heating the medium, and executing processing in relation to an adjustment of the external heater based on the detected temperature.

According to this configuration, processing in relation to the external heater is executed based on the temperature of the heat emitted by the external heater, which is detected by the temperature sensor, and thus, the adjustment of the external heater is facilitated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
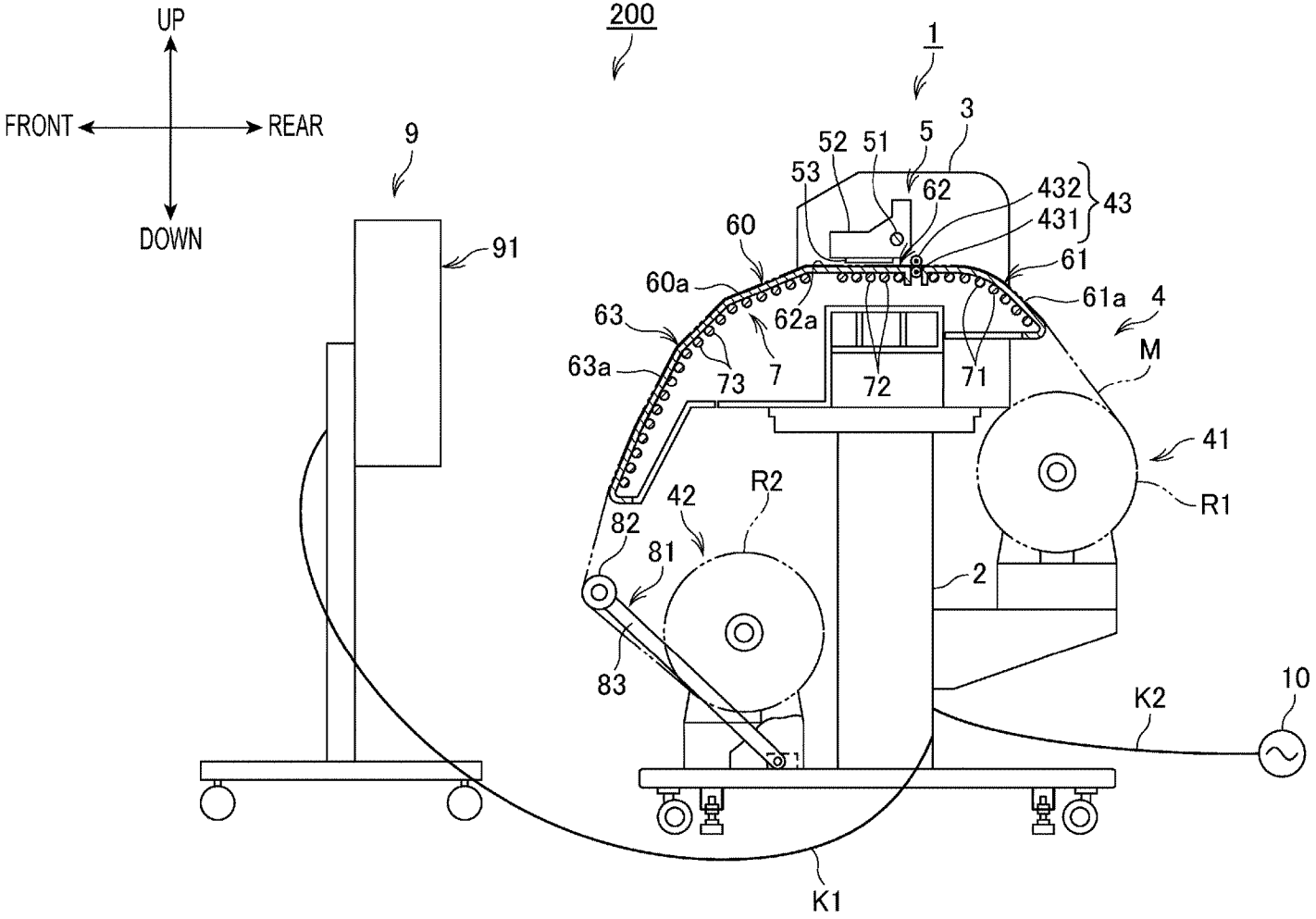
FIG. 1 is a diagram illustrating a configuration of a printing system.

FIG. 1 is a diagram illustrating a configuration of a printing system 200.

In description using FIG. 1, as shown by arrows, a direction toward the left side in the figure will be referred to as a direction toward a "front side". Further, a direction toward the right side in the figure will be referred to as a direction toward a "rear side". Further, a direction toward the upside in the figure will be referred to as a direction toward an "upside". Further, a direction toward the downside in the figure will be referred to as a "downside".

As shown in FIG. 1, the printing system 200 includes a printer 1 (the printing apparatus) and an external heater 9.

The printer 1 is an apparatus configured to print characters, images, and the like by ejecting inks onto a medium M (the medium) by means of an ink jet method, and is a large format printer that executes printing on the medium M of a relatively large size. In the present embodiment, the medium M is a medium having a width of, for example, approximately 64 inches.

As shown in FIG. 1, the printer 1 includes a pedestal 2 and a body 3. This pedestal is provided, at its bottom end, with a plurality of casters. The body 3 is supported by the pedestal 2 and is formed in an approximately rectangular solid shape.

The printer 1 includes a transport unit 4, and this transport unit 4 transports the medium M by means of a roll-to-roll method.

The transport unit 4 includes a feeding section 41 and a winding section 42. The feeding section 41 feeds the medium M from a rolled object R1 toward the body 3. This rolled object R1 is an object obtained by winding the medium M of a long size so as to allow the medium M to be formed in a roll shape. The winding section 42 winds the medium M having been fed by the feeding section 41.

Further, the transport unit 4 includes a transport roller twin 43. This transport roller twin 43 transports the medium M in a state in which the transport roller twin 43 pinches the medium M, on a transport path between the feeding section 41 and the winding section 42. The transport roller twin 43 includes a transport roller 431 and a transport roller 432. The transport roller 431 is disposed on the downside of the transport path and is configured to be rotated. The transport roller 432 is disposed on the upside of the transport path and is configured to be rotated in conjunction with the rotation of the transport roller 431. The transport roller twin 43 allows the rotations of the transport roller 431 and the transport roller 432 to transport the medium M.

Further, the transport unit 4 includes the winding section 42 configured to wind the medium M having been subjected to printing and having been discharged from a discharge outlet disposed on the front side of the body 3, so as to allow the medium M to form a rolled object R2.

The printer 1 includes a printing unit 5, and this printing unit 5 prints characters, images, and the like by ejecting inks onto the medium M.

The printing unit 5 includes a carriage 52, and this carriage 52 reciprocates in a main-scanning direction orthogonal to a transport direction of the medium M (i.e., a direction orthogonal to the paper face in FIG. 1) along a guide shaft 51. This guide shaft 51 is installed across the inside of the body 3. In the carriage 52, an ink jet head 53 is mounted so as to face the medium M being transported in the transport direction. The ink jet head 53 includes a plurality of nozzles that allow inks supplied from unillustrated ink cartridges be ejected through the nozzles themselves. While the carriage 52 is moved in the main-scanning direction, the printing unit 5 executes printing onto the medium M by allowing the inks to be ejected through the nozzles of the ink jet head 53.

There is provided a support member 60 between the feeding section 41 and the winding section 42. The support member 60 includes a support face 60*a*, and this support face 60*a* supports the medium M in such a way that medium M is formed so as to be bent and protrude toward the upside. The support member 60 is constituted by allowing a plurality of members each having a given shape and having been formed through a bending process of a plate material, such as a sheet metal, to be assembled and secured.

The support member 60 includes a feeding support section 61, a printing support section 62, and a discharging support section 63. The feeding section 61 supports the medium M having been fed from the rolled object R1, on the upstream side of the printing unit 5 in the transport path. The printing support section 62 supports a portion that is provided at a position facing the printing unit 5 and that is to be a printed area of the medium M. The discharging support section 63 supports the medium M having been subjected to printing, on the downstream side of the printing unit 5 in the transport path.

The feeding support section 61 includes a support face 61*a*, and this support face 61*a* includes a transport face having a slope ascending toward the downstream side in the transport path. The medium M having been fed from the rolled object R1 and being in a state of being supported by the support face 61*a* is transported to the printing unit 5.

Further, the printing support section 62 includes a support face 62*a*. This support face 62*a* is disposed in a state of allowing a gap to be formed between the support face 62*a* itself and a nozzle formed face of the ink jet head 53. The support face 62*a* is disposed parallel to this nozzle formed face.

The discharging support section 63 forms a transport path between the printing unit 5 and the wining section 42. The discharging support section 63 descends toward the downstream side in this transport path and simultaneously therewith extends while being bent and protruding toward the outside (the front side in FIG. 1). The discharging support section 63 includes a support face 63*a*, and this support face 63*a* supports the medium M in a state in which the support face 63*a* causes the medium M to be bent. The support sections 61, 62, and 63 are disposed in a state in which their respective support faces 61*a*, 62*a*, and 63*a* are formed in a way that allows any adjacent ones of the support faces 61*a*, 62*a*, and 63*a* to be coupled to each other in an approximately flush and seamless state.

As shown in FIG. 1, a heating unit 7 is provided on the backside of the support member 60, and this heating unit 7 heats the support face 60*a*.

More specifically, a preheater 71 is disposed on the back side of the feeding support section 61 to heat the support face 61*a*. The preheater 71 preheats the medium M on the support face 61*a*. Further, a platen heater 72 is disposed on the back side of the printing support section 62 to heat the support face 62*a*, facing the printing unit 5. Further, an afterheater 73 (the heater) is disposed on the back side of the disposing support section 63 to heat the support face 63*a*. The afterheater 73 dries the inks by heating the medium M on the support face 63*a*. The heating unit 7 configured in this way has the function of heating the medium M in a way that allows the inks to be promptly dried and fixated on the medium M so as to allow the occurrence of bleed, blurring, and the like to be reduced, and thereby enhancing the printing quality.

In the present embodiment, a temperature sensor 102 is provided to detect temperature of the afterheater 73 on at least the back side of the discharging support section 63, together with the afterheater 73, which heats the support face 63*a*.

Figure 2:
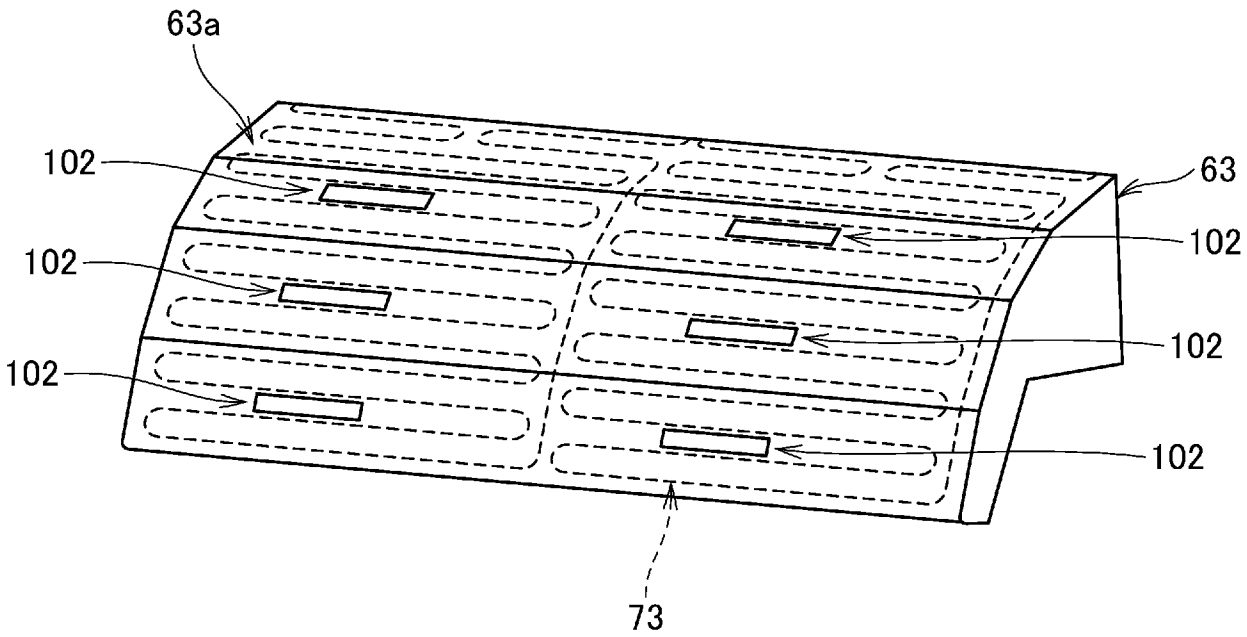
FIG. 2 is a diagram illustrating a state of the installation of an afterheater and a temperature sensor.

FIG. 2 is a diagram illustrating a state of the installation of the afterheater 73 and the temperature sensor 102.

In the present embodiment, the afterheater 73 is constituted by a tube heater, and is bonded to the back side of the support face 63*a* via aluminum tape or the like. Further, as shown in FIG. 2, the afterheater 73 is disposed so as to be capable of heating the entire area of the support face 63*a*. As shown in FIG. 2, the temperature sensor 102 is bonded to the back side of the support face 63*a* between adjacent heating portions of the afterheater 73, and a plurality of the afterheaters 73 are disposed so as to be capable of detecting the temperature of the afterheater 73.

Note that, although a tube heater is exemplified as the afterheater 73, the afterheater 73 is not limited to the tube heater, and any type of heater capable of heating the support face 63*a* can be employed.

Returning to the description using FIG. 1, a tension applying mechanism 81 is provided on the downside of a downstream-side end portion of the discharging support section 63. This tension applying section 81 applies tension to the medium M. Further, the tension applying section 81 includes a tension roller 82, and this tension roller 82 is in contact with the medium M to apply a pressing pressure to the medium M between the discharging support section 63 and the winding section 42. The tension roller 82 is rotatably supported by the tip end portions of a pair of arm members whose base end portions are pivotably supported by the pedestal 2. Further, the tension roller 82 has a shaft length longer than the width of the medium M in a width direction (a direction orthogonal to the paper face of FIG. 1). The medium M in a state of being subjected to tension equivalent to the weight of the tension roller 82 is wound around the rolled object R2 on the downstream side of the discharging support section 63.

As shown in FIG. 1, an external heater 9 is installed on the front side of the printer 1.

The external heater 9 is constituted by, for example, a halogen heater, and includes a heating face 91. From this heating face 91, heat is emitted, and the external heater 9 is installed so as to allow the heating face 91 to face the support face 63*a* of the printer 1. In the present embodiment, the external heater 9 is supplied with electric power from the printer 1 via a cable K1, and emits heat toward the support face 63*a* on the basis of the supplied electric power. Thus, the medium M on the support face 63*a* is heated by the external heater 9 and the afterheater 73.

Further, the printer 1 is supplied with alternative-current electric power from a commercial alternative-current power source 10 via a cable K2, and allows an unillustrated power supply circuit to execute a rectification process, a smoothing process, a voltage conversion process, and the like, and thereby generate direct-current electric power, and the printer 1 executes operation on the basis of the generated direct-current electric power.

Figure 3:
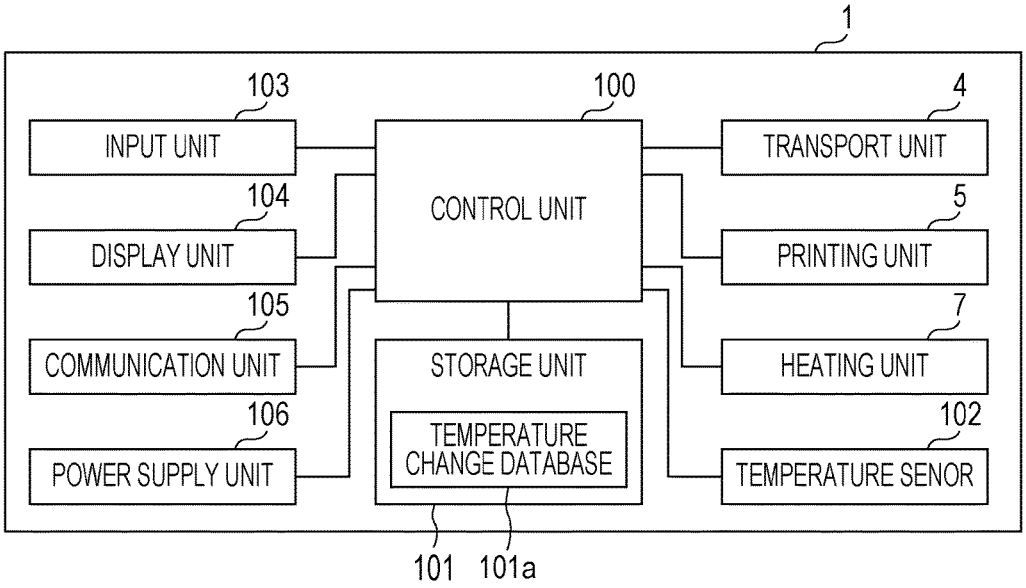
FIG. 3 is a diagram illustrating a functional configuration of a printer.

FIG. 3 is a diagram illustrating a functional configuration of the printer 1.

As shown in FIG. 3, the printer 1 includes a control unit 100, a storage unit 101, the transport unit 4, the printing unit 5, the heating unit 7, the temperature sensor 102, and an input unit 103, a display unit 104 (the reporting unit and the instructing unit), a communication unit 105, and a power supply unit 106.

The control unit 100 includes a CPU, ROM, RAM, other control circuits, and the like, and controls individual portions of the printer 1.

The storage unit 101 includes nonvolatile memory devices, such as EEPROM and a hard disc, and stores various kinds of data therein in a rewritable way. Further, the storage unit 101 stores therein temperature change database 101*a*. This temperature change database 101*a* will be described later.

The transport unit 4 includes the above-described feeding section 41, winding section 42, and transport roller twin 43, and other components in relation to the transport of the medium M. The transport unit 4 transports the medium M under the control of the control unit 100.

The printing unit 5 includes the above-described ink jet head 53, a driving circuit for driving the ink jet head 53, the above-described carriage 52, a scanning motor for allowing the carriage 52 to scan in a main-scanning direction intersecting with the transport direction, a motor driver for driving the scanning motor, and other components in relation to the printing on the medium M. The printing unit 5 prints characters, images, and the like on the medium M under the control of the control unit 100.

The heating section 7 includes the above-described preheater 71, platen heater 72, and afterheater 73, and heats the medium M being transported under the control of the control unit 100. As described above, the preheater 71 preheats the medium M on the support face 61*a*. Further, the platen heater 72 heats the medium M on the support face 62*a*. Moreover, the afterheater 73 heats the medium M on the support face 63*a*.

The temperature sensor 102 is a sensor for detecting, at least, temperature of the afterheater 73, and is disposed on the backside of the support face 63*a* so as to be capable of detecting the temperature of the afterheater 73. The temperature sensor 102 outputs a signal indicating the detected temperature (for example, a voltage corresponding to the detected temperature) to the control unit 100.

The input unit 103 includes input means provided in the printer 1, such as operation switches or a touch panel; detects user's operations using the input means; and outputs the detected operations to the control unit 100. The control unit 100 executes processes corresponding to the respective operations using the input means on the basis of inputs from the input unit 103.

The display unit 104 includes a plurality of LEDs, a display panel, and the like, and executes the light-on/off of the LEDs in accordance with a predetermined specification, the display of information on the display panel, and the like under the control of the control unit 100. In the present embodiment, through the display of information, the display unit 104 functions as a reporting unit for reporting information to a user. Further, when the displayed information is information indicating a predetermined instruction, the display unit 104 functions as an instructing unit for issuing of an instruction to a user. Here, in the present embodiment, it is assumed that the light on/off of the LEDs in accordance with a predetermined specification is also equivalent to the display of information.

The communication unit 105 communicates with, for example, a host computer (not illustrated) for controlling the operation of the printing by the printer 1 in accordance with a predetermined communication protocol under the control of the control unit 100.

The power supply unit 106 is connected to the commercial alternative-current power source 10 via the cable K2; generates direct-current electric power by executing processes, such as a rectification process, a smoothing process, and a voltage conversion process, on alternative-current electric power supplied from the commercial alternative-current power source 10; and supplies the generated direct-current electric power to individual portions of the printer 1. The printer 1 operates on the basis of the supplied direct-current electric power. Further, the power supply unit 106 supplies driving electric power to the external heater 9 via the cable K1 under the control of the control unit 100. Here, the external heater 9 may be supplied with the alternative-current electric power as it is, or may be supplied with direct-current electric power resulting from rectifying the alternative-current electric power.

As described above, the printer 1 allows the inks having been ejected on the medium M to be fixated on the medium M by allowing the medium M to be dried by the heating of the medium M by the preheater 71, the platen heater 72, and the afterheater 73. In this case, however, even after the heating by the afterheater 73, the inks having been ejected on the medium M may not be perfectly dried because of the difference in the kind of used inks, and the like. In such a case, as a result, a relatively long period (for example, approximately one day) is needed until the perfect drying of the inks.

Thus, there occurs a case where, in order to shorten the period until the perfect drying of the inks, as shown in FIG. 1, a user installs the external heater 9 at the afterheater 73 side of the printer 1, and heats the medium M while concurrently using the external heater 9. In this case, in order to prevent the degradation of the printing quality due to overheating by the external heater 9, it is required to appropriately adjust the output, the installation position and the like of the external heater 9. Heretofore, however, conventional methods for adjusting the external heater 9 tend to depend on user's feeling and experiences, and thus, the adjustment of the external heater 9 has not sometimes been facilitated.

Further, there occurs a case where the printer 1 is configured such that, in order to ensure the safety, the prevention of the influence due to the rising of temperature, and the like, a temperature at which the operation of the printer 1 is caused to be stopped (this temperature being expressed as "an abnormal temperature" hereinafter) is set in advance, and the operation of the printer 1 is caused to be stopped when the temperature of the afterheater 73 has risen above the abnormal temperature (the predetermined value). In this case, however, when, as shown in FIG. 1, a user heats the medium M while concurrently using the external heater 9, the temperature of the afterheater 73 is highly likely to rise above the abnormal temperature. Thus, when the user concurrently uses the external heater 9, the operation of the printer 1 is likely to be stopped due to the occurrence of the event in which the temperature of the afterheater 73 rises above the abnormal temperature. This leads to the degradation of the convenience for the user when the user concurrently uses the external heater 9.

Thus, the printer 1 according to the present embodiment executes operation described below.

Figure 4:
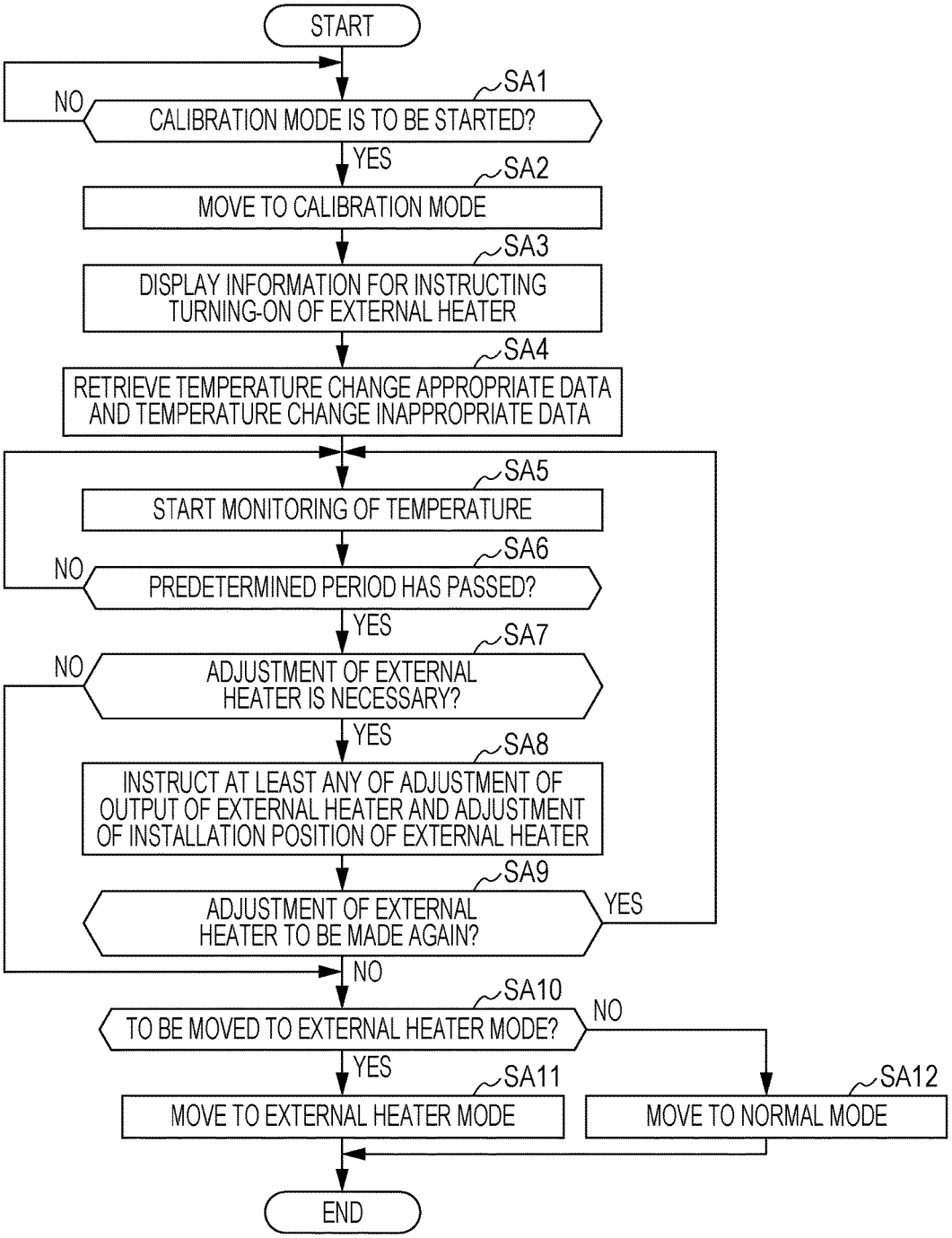
FIG. 4 is a flowchart illustrating the operation of the printer.

FIG. 4 is a flowchart illustrating the operation of the printer 1 according to the present embodiment.

In description using FIG. 4, it is assumed that the printer 1 does not execute the operation of printing, and does not execute at least the heating by the afterheater 73.

The control unit 100 of the printer 1 determines whether or not a calibration mode (the first mode) is to be started (step SA1). The calibration mode is an operation mode which is provided in the printer 1 and in which processing in relation to the adjustment of the external heater 9 is executed on the basis of the temperature of heat emitted by the external heater 9. In the present embodiment, the processing in relation to the adjustment of the external heater 9 means, as shown in description below, processing for issuing of an instruction for instructing at least any of the adjustment of the output of the external heater 9 and the adjustment of the installation position of the external heater 9.

For example, upon detection of an operation for instructing the start of the calibration mode through an input to the input means provided in the input unit 103, the control unit 100 determines that the calibration mode is to be started (step SA1: YES).

When having determined that the calibration mode is to be started (step SA1: YES), the control unit 100 moves the operation mode of the printer 1 to the calibration mode (step SA2).

Next, after the movement of the operation mode of the printer 1 to the calibration mode, the control unit 100 allows the display unit 104 to display information for instructing the turning-on of the external heater 9 (step SA3). Here, the turning-on of the external heater 9 does not mean the turning-on of electric power for the external heater 9, but means the turning-on of the generation of heat by the external heater 9.

In this way, in the case where the operation mode of the printer 1 is in the calibration mode, the control unit 100 allows the display unit 104 to display the information for instructing the turning-on of the external heater 9. Thus, the occurrence of a situation where the control unit 100 executes the calibration mode in a state in which the external heater 9 is not turned on by a user is prevented.

Here, the control unit 100 may be configured to allow the display in step SA3 to be performed until the termination of the calibration mode or during a predetermined period from the start of the calibration mode.

Next, the control unit 100 retrieves a pair of temperature change appropriate data and temperature change inappropriate data from the temperature change database 101*a* stored by the storage unit 101 (step SA4). The temperature change database 101*a* is a database in which the pair of the temperature change appropriate data and the temperature change inappropriate data is stored.

Figure 5:
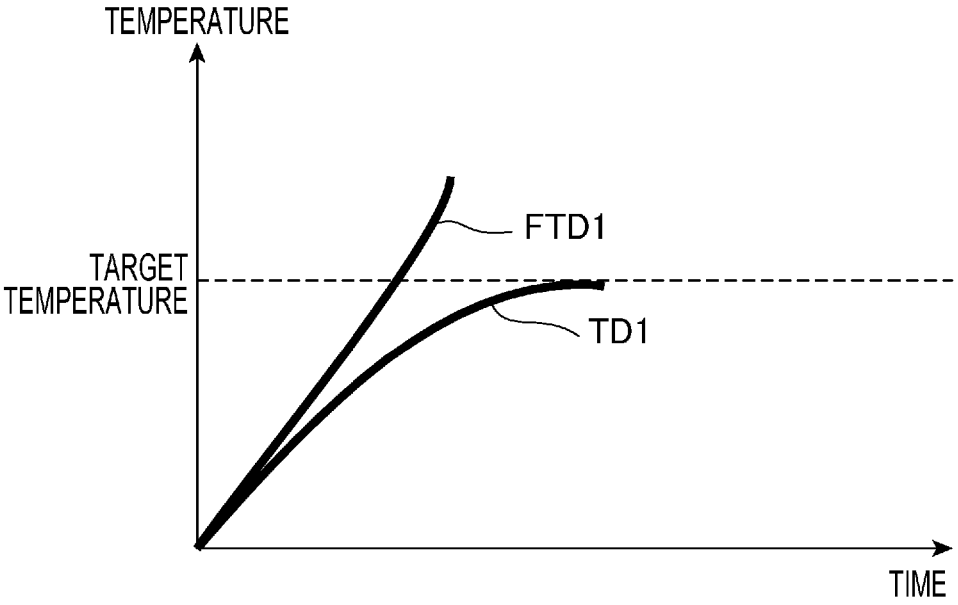
FIG. 5 is a diagram illustrating an example of temperature change appropriate data and temperature change inappropriate data.

FIG. 5 is a diagram illustrating an example of the pair of the temperature change appropriate data and the temperature change inappropriate data. In FIG. 5, the vertical axis indicates temperature. Further, in FIG. 5, the horizontal axis indicates time.

As shown in FIG. 5, as compared with temperature change inappropriate data FTD1, temperature change appropriate data TD1 is data indicating a temperature change in which the rising of temperature with time elapse is moderate and gradually becomes close to a target temperature. This temperature change appropriate data TD1 indicates a temperature change based on an assumption that the transport of the medium M is made. In general, it is known that the rising of the temperature detected by the temperature sensor 102 reaches a plateau at a certain temperature because the transfer of the medium M causes a portion included in the medium M and having been heated by the heat emitted by the external heater 9 to be moved to the outside of a detection range of the temperature sensor 102. For this reason, the temperature at which the rising of temperature reaches a plateau is set as a target temperature, and the temperature change appropriate data TD1 indicates a temperature change gradually becoming close to this target temperature.

Here, the target temperature is a temperature which, for the temperature of the heat emitted by the external heater 9, is recommended by actors of a manufacturer of the printer 1, and at which the printing quality is not degraded even when the external heater 9 is concurrently used. This target temperature is calculated through tests, simulations, and the like having been made in advance. Note that the target temperature is a temperature different from a preset temperature and an abnormal temperature that will be described later, and the target temperature is absolutely a temperature that is set as a reference relative to the temperature of the heat emitted by the external heater 9 in the calibration mode in which the operation of printing is not executed.

In this way, the temperature change appropriate data TD1 is data indicating a temperature change gradually becoming close to the target temperature. Thus, in the present embodiment, the status in which the temperature change of the heat emitted by the external heater 9 approaches the temperature change appropriate data TD1 indicates that the temperature change of the heat emitted by the external heater 9 is an appropriate temperature change that does not degrade the printing quality even when the external heater 9 is concurrently used.

As shown in FIG. 5, as compared with the temperature change appropriate data TD1, the temperature change inappropriate data FTD1 is data indicating a temperature change in which the rising of temperature with time elapse is steep and rises above the target temperature without gradually becoming close to the target temperature. This temperature change inappropriate data FTD1 indicates, just like the temperature change appropriate data TD1, a temperature change based on an assumption that the transfer of the medium M is made. That is, this temperature change inappropriate data FTD1 is data for which it is taken into consideration that heat is taken by the transfer of the medium M. The temperature change inappropriate data FTD1, however, indicates a temperature change in which the temperature of heat rises without gradually becoming close to the target temperature. This shows that, although heat is taken by the transfer of the medium M, the temperature of heat rises because the temperature of the heat emitted by the external heater 9 is too high.

As described above, the temperature change inappropriate data FTD1 is data indicating a temperature change in which the rising of temperature with time elapse is steep, and rises above the target temperature. Thus, in the present embodiment, the status in which the temperature change of the heat emitted by the external heater 9 approaches the temperature change inappropriate data FTD1 indicates that the temperature change of the heat emitted by the external heater 9 is a temperature change having a probability that the printing quality is degraded when the external heater 9 is concurrently used.

Here, the temperature change appropriate data TD1 and the temperature change inappropriate data FTD1 are data having been obtained through tests, simulations, and the like having been made in advance.

Returning to the description of the flowchart shown in FIG. 4, upon retrieval of the pair of the temperature change appropriate data TD1 and the temperature change inappropriate data FTD1 from the temperature change database 101*a*, the control unit 100 starts the monitoring of the temperature of the heat emitted by the external heater 9 on the basis of temperature detected by the temperature sensor 102 (step SA5). As described above, the temperature sensor 102 is a temperature sensor for detecting the temperature of the afterheater 73. That is, the temperature sensor 102 indirectly detects the temperature of the heat emitted by the external heater 9 by detecting the temperature of the afterheater 73.

The control unit 100 monitors the temperature of the heat emitted by the external heater 9 during a predetermined period (for example, one minute).

Next, the control unit 100 determines whether or not the predetermined period has passed from the start of the monitoring of the heat emitted by the external heater 9 (step SA6). For example, the control unit 100 counts a unit period using an unillustrated timer, and in the case where counted unit periods are larger than or equal to predetermined unit periods, the control unit 100 determines that the predetermined period has passed from the start of the monitoring of the heat emitted by the external heater 9. In contrast, in the case where the counted unit periods are smaller than the predetermined unit periods, the control unit 100 determines that the predetermined period has not yet passed from the start of the monitoring of the heat emitted by the external heater 9.

When having determined that the predetermined period has not yet passed from the start of the monitoring of the heat emitted by the external heater 9 (step SA6: NO), the control unit 100 returns the process flow to step SA5 and then continues the monitoring of the heat emitted by the external heater 9.

In contrast, when having determined that the predetermined period has passed from the start of the monitoring of the heat emitted by the external heater 9 (step SA6: YES), the control unit 100 determines whether or not the adjustment of the external heater 9 is necessary (step SA7).

In step SA7, the control unit 100 determines whether or not the control of the external heater 9 is necessary on the basis of the temperature that is related to the heat emitted by the external heater 9 and that has been monitored during the predetermined period as well as the pair of the temperature change appropriate data TD1 and the temperature change inappropriate data FTD1, which has been retrieved in step SA4.

Here, the process in step SA7 will be described below in detail using a plurality of specific examples.

EXAMPLE 1

First, example 1 will be described.

Here, in example 1, it is assumed that the temperature change of the heat emitted by the external heater 9 during the predetermined period is a change of temperature that rises with time elapse.

The control unit 100 obtains a temperature change of the heat emitted by the external heater 9 during the predetermined period on the basis of a monitored temperature of the heat emitted by the external heater 9. Next, the control unit 100 calculates the degree (for example, gradient) of the temperature change relative to the passed period of time. Further, the control unit 100 compares the degree of the calculated temperature change, the degree of the temperature change indicated by the temperature change appropriate data TD1, and the degree of the temperature change indicated by the temperature change inappropriate data FTD1. Further, in the case where the calculated degree is closer relative to the degree of the temperature change indicated by the temperature change appropriate data TD1 than relative to the degree of the temperature change indicated by the temperature change inappropriate data FTD1, the control unit 100 determines that the adjustment of the external heater 9 is unnecessary. In contrast, in the case where the calculated degree is closer relative to the degree of the temperature change indicated by the temperature change inappropriate data FTD1 than relative to the degree of the temperature change indicated by the temperature change appropriate data TD1, the control unit 100 determines that the adjustment of the external heater 9 is necessary.

Through such a determination as to which of the temperature change indicated by the temperature change appropriate data TD1 and the temperature change indicated by the temperature change inappropriate data FTD1 the temperature change of the heat emitted by the external heater 9 is closer to, the control unit 100 determines whether or not the heat emitted by the external heater 9 is likely to rise above the target temperature, and thereby determines whether or not the adjustment of the external heater 9 is necessary.

EXAMPLE 2

Next, example 2 will be described.

The control unit 100 determines whether or not a temperature indicating a value higher than or equal to the target temperature has been detected during a predetermined period while the monitoring is executed, on the basis of the monitored temperature of the heat emitted by the external heater 9. When having detected a temperature indicating a value higher than the target temperature during the predetermined period, the control unit 100 determines that the temperature change obtained on the basis of the monitored temperature is closer relative to the temperature change indicated by the temperature change inappropriate data FTD1 than relative to the temperature change indicated by the temperature change appropriate data TD1, the control unit 100 determines that the adjustment of the external heater 9 is necessary. In contrast, when having not detected any temperature indicating a value higher than the target temperature during the predetermined period, the control unit 100 determines that the temperature change obtained on the basis of the monitored temperature is closer relative to the temperature change indicated by the temperature change appropriate data TD1 than relative to the temperature change indicated by the temperature change inappropriate data FTD1, the control unit 100 determines that the adjustment of the external heater 9 is unnecessary.

Through such a determination as to whether or not the temperature of the heat emitted by the external heater 9 has risen above the target temperature, the control unit 100 determines which of the temperature change indicated by the temperature change appropriate data TD1 and the temperature change indicated by the temperature change inappropriate data FTD1 the temperature change of the heat emitted by the external heater 9 is closer to, and thereby determines whether or not the adjustment of the external heater 9 is necessary.

Here, the control unit 100 may be configured to determine whether or not the adjustment of the external heater 9 is necessary, in view of both of example 1 and example 2.

Returning to the description of the flowchart shown in FIG. 4, when having determined that the adjustment of the external heater 9 is necessary (step SA7: YES), the control unit 100 allows the display unit 104 to perform issuing of an instruction for instructing at least any of the adjustment of the output of the external heater 9 and the adjustment of the installation position of the external heater 9 (step SA8). For example, the control unit 100 instructs the adjustment of the installation position of the external heater 9 by displaying a message such as "Move external heater to a position further distant from printer, please". Further, for example, the control unit 100 instructs the adjustment of the output of the external heater 9 by displaying a message such as "Decrease output of external heater, please". Note that, in step SA8, the control unit 100 allows the display unit 104 to perform issuing of an instructing for instructing at least any of the adjustment of the output of the external heater 9 and the adjustment of the installation position of the external heater 9, and thus, the display unit 104 functions as the instructing unit.

As described above, when having determined that the adjustment of the external heater 9 is necessary, the control unit 100 instructs at least any of the adjustment of the output of the external heater 9 and the adjustment of the installation position of the external heater 9. Thus, a user is able to recognize whether or not each of the adjustment of the output of the external heater 9 and the adjustment of the installation position of the external heater 9 is appropriate, and thus, the user is able to easily adjust the external heater 9 without depending on the feeling, experiences, and the like of the user.

Note that, when having determined that the adjustment of the external heater 9 is necessary (step SA7: YES), the control unit 100 may allow the display unit 104 to report information indicating that the temperature of the heat emitted by the external heater 9 is not within an acceptable range. Here, the acceptable range indicates a range within which the temperature of the heat emitted by the external heater 9 is lower than or equal to the target temperature. For example, the control unit 100 performs lighting-on of one of the LEDs in accordance with a predetermined specification and thereby reports information indicating that the temperature of the heat emitted by the external heater 9 is not within an acceptable range. With this configuration, upon execution of such reporting by the display unit 104, a user is able to recognize that the temperature of the heat emitted by the external heater 9 is not within an acceptable range, provided that the user is able to recognize that the lighting-on of the LED in accordance with a predetermined specification indicates that the temperature of the heat emitted by the external heater 9 is not within an acceptable range. Thus, the user is able to recognize whether or not the adjustment of the external heater 9 is appropriate, and thus is able to easily adjust the external heater 9 without depending on the feeling, experiences, and the like of the user. A configuration that allows such reporting to be also made when the temperature of the heat emitted by the external heater 9 is likely to rise above the target temperature is also applicable. That is, the control unit 100 may be configured such that, even in the case where, actually, the temperature of the heat emitted by the external heater 9 does not rise above the target temperature, when it has been determined that the temperature of the heat emitted by the external heater 9 is likely to rise above the target temperature, reporting of this determination is made. With this configuration, the control unit 100 is capable of making such reporting before the temperature of the heat emitted by the external heater 9 reaches above the target temperature.

Note that, in this case, the control unit 100 allows the display unit 104 to make reporting of information indicating that the temperature of the heat emitted by the external heater 9 is not within an acceptable range, and thus, the display unit 104 functions as the reporting unit.

Returning to the description of the flowchart shown in FIG. 4, when having allowed the display unit 104 to perform issuing of an instruction for instructing at least any of the adjustment of the output of the external heater 9 and the adjustment of the installation position of the external heater 9, the control unit 100 determines whether or not the adjustment of the external heater 9 is to be made again (step SA9).

For example, after having displayed a message such as "Do you want readjustment of external heater?", upon detection of a operation for instructing the execution of readjustment of the external heater 9, the control unit 100 determines that the adjustment of the external heater 9 is to be made again (step SA9: YES). When having determined that the adjustment of the external heater 9 is necessary, the control unit 100 returns the process flow to step SA5.

In contrast, when having determined that the adjustment of the external heater 9 is not to be made again (step SA9: NO), the control unit 100 determines whether or not the operation mode of the printer 1 is to be moved to an external heater mode (the second mode) (step SA10). When determining whether or not the operation mode of the printer 1 is to be moved to an external heater mode, the control unit 100 waits for a reception of an instruction by a user for indicating the presence/absence of necessity of the movement to the external heater mode. Here, the external heater mode is an operation mode which is provided in the printer 1 and in which the operation of the printer 1 is not caused to be stopped even when the temperature of the afterheater 73 has risen above the abnormal temperature.

For example, the control unit 100 displays a message such as "Do you want movement to external heater mode?", and then, waits for a reception of an instruction by a user for indicating the presence/absence of necessity of the movement to the external heater mode. Further, upon reception of an instruction for indicating the presence of necessity of the movement to the external heater mode, the control unit 100 determines that the operation mode of the printer 1 is to be moved to the external heater mode (step SA10: YES). Further, upon reception of an instruction for indicating the absence of necessity of the movement to the external heater mode, the control unit 100 determines that the operation mode of the printer 1 is not to be moved to the external heater mode (step SA10: NO).

When having determined that the movement to the external heater mode is to be made, the control unit 100 moves the operation mode of the printer 1 to the external heater more (step SA11).

As described above, when, as shown in FIG. 1, a user heats the medium M while concurrently using the external heater 9, the temperature of the afterheater 73 is likely to rise above the abnormal temperature, and further, in the case where the temperature of the afterheater 73 rises above the abnormal temperature during the concurrent use of the external heater 9, the printer 1 is likely to stop its printing operation. In the case where, however, the operation mode of the printer 1 is the external heater mode, the printer 1 does not stop its operation even when the temperature of the afterheater 73 has risen above the abnormal temperature. Thus, when a user concurrently uses the external heater 9, the stop of the operation of the printer 1 is prevented. Further, when the external heater 9 is used, in the case where a user uses a medium having a higher heat tolerance than a pure medium, the medium having a high heat tolerance can be heated at a higher temperature than a case of the pure medium, and thus, the scope of the selection of a medium and the scope of the selection of a heating method are broadened, and the convenience for a user is increased.

In contrast, when having determined that the movement to the external heater mode is not to be made (step SA10: NO), the control unit 100 moves the operation mode of the printer 1 to a normal mode (step SA12). The normal mode is an operation mode which is provided in the printer 1 and in which the operation of the printer 1 is caused to be stopped when the temperature of the afterheater 73 has risen above the abnormal temperature. In this way, when having determined that the movement to the external heater mode is not to be made, on the basis of the operation by a user, the control unit 100 moves the operation mode of the printer 1 to the normal mode. Thus, when the temperature of the afterheater 73 has risen above the abnormal temperature, the control unit 100 is capable of stopping its operation, and thus, the safety of the printer 1 is ensured. Further, the control unit 100 is also capable of preventing the influence on the printer 1 due to the rising of the temperature of the afterheater 73.

Next, the operation of the printer 1 in a case where the operation of printing is involved will be described.

Figure 6A:
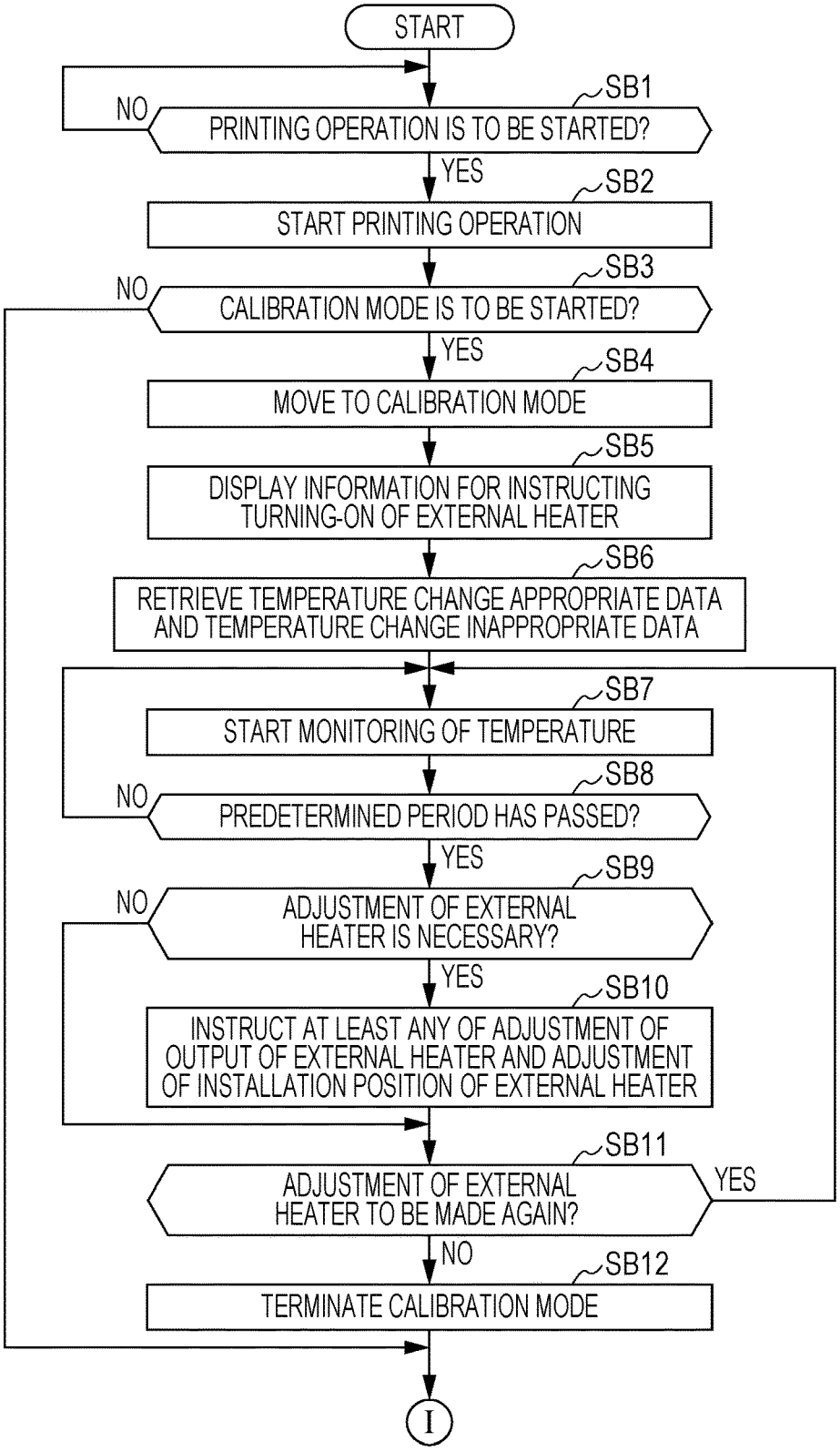
FIGS. 6A and 6B illustrate a flowchart illustrating another operation of the printer.
Figure 6B:
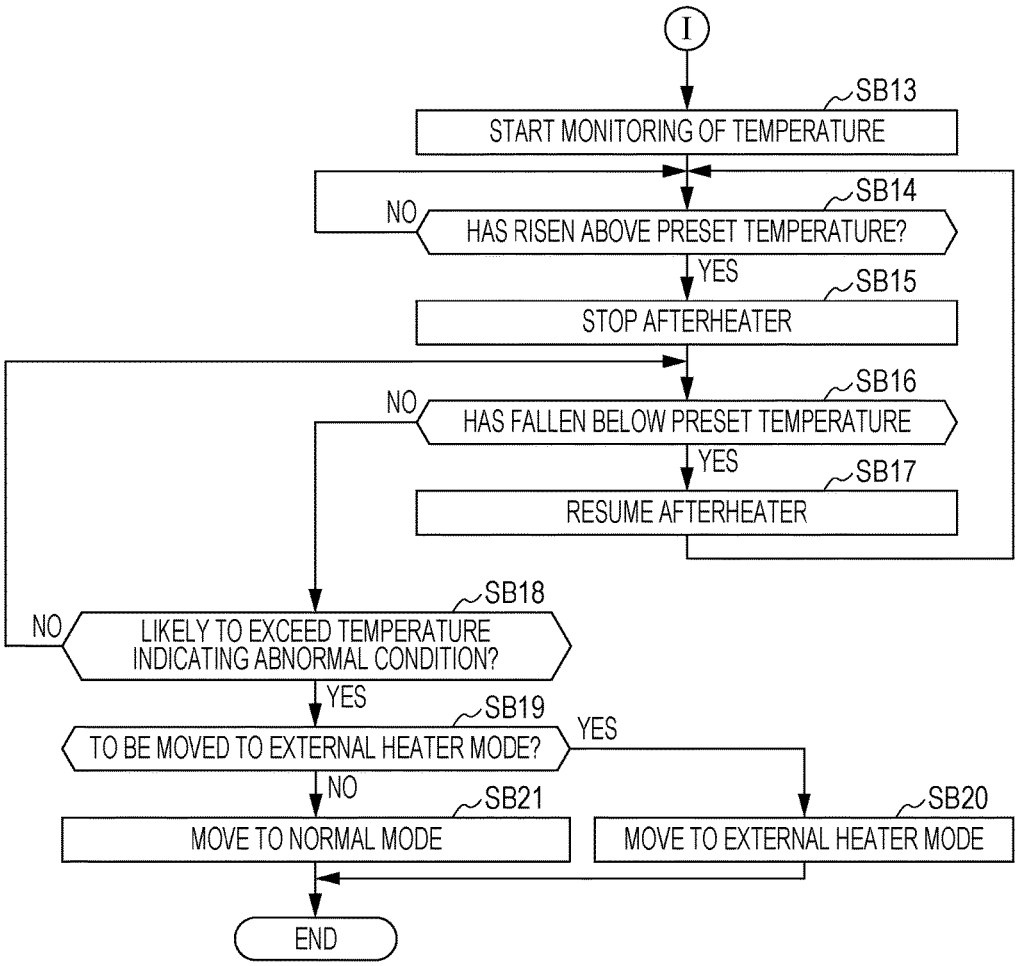

FIGS. 6A and 6B illustrate a flowchart of another operation of the printer 1 in the present embodiment. When compared with the flowchart illustrated in FIG. 4, the flowchart shown in FIGS. 6A and 6B illustrates the operation of the printer 1 in the case where the operation of printing is involved.

In the description using FIGS. 6A and 6B, unlike the description using FIG. 4, it is assumed that the afterheater 73 executes heating in the calibration mode.

The control unit 100 of the printer 1 determines whether or not the operation of printing is to be started (step SB1). For example, upon reception of printing data from the unillustrated host computer by the communication unit 105, the control unit 100 determines that the operation of printing is to be started (step SB1: YES).

Next, when having determined that the operation of printing is to be started (step SB1: YES), the control unit 100 of the printer 1 starts the operation of printing based on the printing date (step SB2).

Next, the control unit 100 determines whether or not a calibration mode is to be started (step SB3). When having determined that the calibration mode is not to be started, the control unit 100 moves the process flow to step SB13. A process of step SB13 will be described later. In contrast, when having determined that the calibration mode is to be started (step SB3: YES), the control unit 100 moves the operation of the printer 1 to the calibration mode (step SB4).

Next, after the movement of the operation mode of the printer 1 to the calibration mode, the control unit 100 allows the display unit 104 to display information for instructing turning-on of the external heater 9 (step SB5). With this operation, the same advantageous effect as the above-described advantageous effect is brought about.

Next, the control unit 100 retrieves a pair of temperature change appropriate data and temperature change inappropriate data from the temperature change database 101*a* stored by the storage unit 101 (step SB6). Here, the pair of temperature change appropriate data and temperature change inappropriate data that is retrieved from the temperature change database 101*a* by the control unit 100 is different from the pair of the two kinds of data having been retrieved in step SA4 in the flowchart of FIG. 4.

Figure 7:
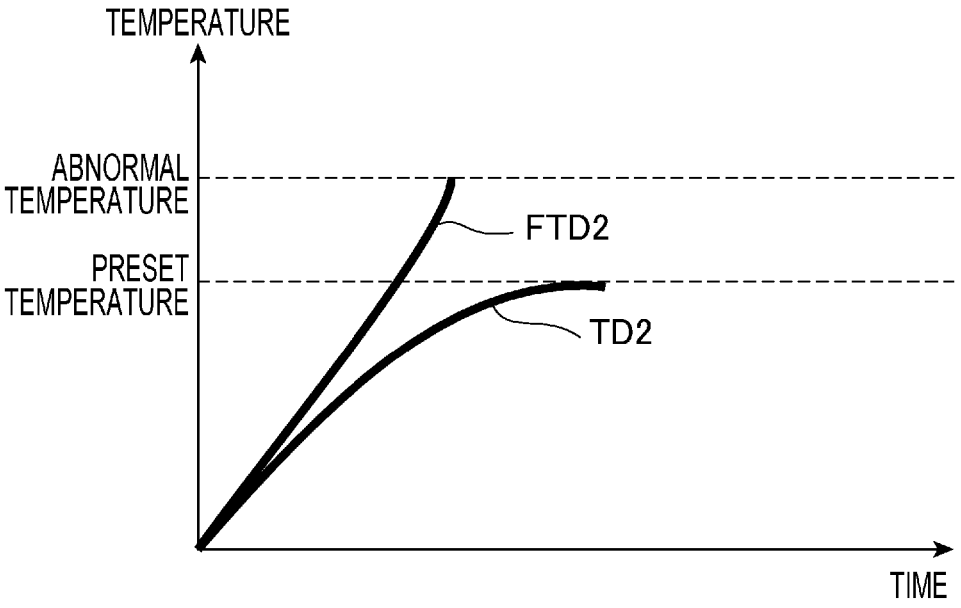
FIG. 7 is a diagram illustrating another example of temperature change appropriate data and temperature change inappropriate data.

FIG. 7 is a diagram illustrating an example of the pair of the temperature change appropriate data and the temperature change inappropriate data. In FIG. 7, the vertical axis indicates temperature. Further, in FIG. 7, the horizontal axis indicates time.

As shown in FIG. 7, as compared with temperature change inappropriate data FTD2, temperature change appropriate data TD2 is data indicating a temperature change in which the rising of temperature with time elapse is moderate and gradually becomes close to a preset temperature. Note that the temperature change appropriate data TD2 is data different from the temperature change appropriate data TD1, and is data indicating a temperature change for which the heating by the afterheater 73 is taken into consideration. This temperature change appropriate data TD2 indicates a temperature change based on an assumption that the transport of the medium M is made. In general, the rising of the temperature of the afterheater 73, which is detected by the temperature sensor 102, reaches a plateau at a certain temperature because part of the heat emitted by the external heater 9 and part of the heat of the afterheater 73 are taken by the transfer of the medium M. Thus, this temperature at which the rising of temperature reaches a plateau is set as a preset temperature, and the temperature change appropriate data TD2 indicates a temperature change gradually becoming close to this preset temperature.

The preset temperature is a temperature that, for the temperature of the afterheater 73, is set for a case where the medium M is heated, and that is recommended by actors of a manufacturer of the printer 1 for the case where the medium M is heated. This preset temperature is determined through tests, simulations, and the like having been made in advance.

The temperature change appropriate data TD2 indicates data indicating a temperature change gradually becoming close to the preset temperature. Thus, in the present embodiment, the status in which the temperature change of the afterheater 73 involving the temperature change of the heat emitted by the external heater 9 approaches the temperature change appropriate data TD2 indicates that the temperature change based on the temperature detected by the temperature sensor 102 is an appropriate temperature change that does not degrade the printing quality even when the external heater 9 is concurrently used.

As shown in FIG. 7, as compared with the temperature change appropriate data TD2, the temperature change inappropriate data FTD2 is data indicating a temperature change in which the rising of temperature with time elapse is steep; the rising of temperature rises above the preset temperature along with time elapse; and further, the rising of temperature becomes close to the abnormal temperature along with time elapse. Here, the temperature change inappropriate data FTD2 is data different from the temperature change inappropriate data FTD1, and is data indicating a temperature change for which the heating by the afterheater 73 is taking into consideration. This temperature change inappropriate data FTD2 indicates a temperature change based on an assumption that the transport of the medium M is made, just like the temperature change appropriate data TD2. That is, this temperature change inappropriate data FTD2 is data for which it is taken into consideration that heat is taken by the transport of the medium M. The temperature change inappropriate data FTD2, however, indicates a temperature change in which the temperature of the heat rises without gradually becoming close to the preset temperature. This indicates that, although heat is taken by the transfer of the medium M, the temperature of the heat rises because the temperature of the heat emitted by the external heater 9 is too high.

As described above, the temperature change inappropriate data FTD2 is data indicating a temperature change in which the rising of temperature with time elapse is steep; rises above the preset temperature; and becomes close to the abnormal temperature. Thus, in the present embodiment, the status in which the temperature change of the afterheater 73 involving the temperature change of the heat emitted by the external heater 9 approaches the temperature change inappropriate data FTD2 indicates that the temperature change based on the temperature detected by the temperature sensor 102 is a temperature change having a probability that the printing quality is degraded when the external heater 9 is concurrently used.

Returning to the description of the flowchart shown in FIGS. 6A and 6B, upon retrieval of a pair of the temperature change appropriate data TD2 and the temperature change inappropriate data FTD2 from the temperature change database 101*a*, the control unit 100 allows the temperature sensor 102 to start the monitoring of the temperature of the afterheater 73 (step SB7). The control unit 100 monitors the temperature of the afterheater 73 during a predetermined period (for example, one minute). As described above, the temperature sensor 102 indirectly detects the temperature of the heat emitted by the external heater 9 by detecting the temperature of the afterheater 73. That is, in the case where the external heater 9 emits heat, the detection of the temperature of the afterheater 73 by the temperature sensor 102 is equivalent to the detection of the temperature for the external heater 9 by the temperature sensor 102.

Next, the control unit 100 determines whether or not the predetermined period has passed from the start of the monitoring of the heat of the afterheater 73 (step SB8). When having determined that the predetermined period has not yet passed from the start of the monitoring of heat of the afterheater 73 (step SB8: NO), the control unit 100 returns the process flow to step SB7 and then continues the monitoring of the heat of the afterheater 73.

In contrast, when having determined that the predetermined period has passed from the start of the monitoring of the heat of the afterheater 73 (step SB8: YES), the control unit 100 determines whether or not the adjustment of the external heater 9 is necessary (step SB9).

The control unit 100 determines whether or not the control of the external heater 9 is necessary on the basis of the temperature of the afterheater 73, which has been monitored during the predetermined period in step SB9, and the pair of the temperature change appropriate data TD2 and the temperature change inappropriate data FTD2, which has been retrieved in step SB6.

Returning to the description of the flowchart shown in FIGS. 6A and 6B, when having determined that the adjustment of the external heater 9 is necessary (step SB9: YES), the control unit 100 allows the display unit 104 to perform issuing of an instruction for instructing at least any of the adjustment of the output of the external heater 9 and the adjustment of the installation position of the external heater 9 (step SB10). In this case as well, the same advantage effect as the above-described advantageous effect is brought about.

Note that, when having determined that the adjustment of the external heater 9 is necessary (step SB9: YES), the control unit 100 may allow the display unit 104 to report information indicating that the temperature of the heat emitted by the external heater 9 is not within an acceptable range. In this case as well, the same advantage effect as the above-described advantageous effect is brought about.

When having allowed the display unit 104 to perform issuing of an instruction for instructing at least any of the adjustment of the output of the external heater 9 and the adjustment of the installation position of the external heater 9, the control unit 100 determines whether or not the adjustment of the external heater 9 is to be made again (step SB11).

When having determined that the adjustment of the heater 9 is to be made again (step SB11: YES), the control unit 100 returns the process flow to step SB9. In contrast, when having determined that the adjustment of the external heater 9 is not to be made again (step SB11: NO), the control unit 100 terminates the calibration mode (step SB12), and allows the temperature sensor 102 to monitor the temperature of the afterheater 73 (step SB13).

Next, the control unit 100 determines whether or not the temperature of the afterheater 73 has risen above the preset temperature on the basis of the monitored temperature of the afterheater 73 (step SB14).

When having determined that the temperature of the afterheater 73 does not rise above the preset temperature (step SB14: NO), the control unit 100 continues the process of step SB14. In contrast, when having determined that the temperature of the afterheater 73 has risen above the preset temperature (step SB14: YES), the control unit 100 stops the heating by the afterheater 73 (step SB15). Further, the control unit 100 allows the display unit 104 to report information indicating that the temperature of the afterheater 73 has risen above the preset temperature.

Next, after having stopped the heating by the afterheater 73, the control unit 100 determines whether or not the temperature of the afterheater 73 has fallen below the preset temperature on the basis of the temperature of the afterheater 73, which is detected by the temperature sensor 102 (step SB16).

When having determined that the temperature of the afterheater 73 has fallen below the preset temperature (step SB16: YES), the control unit 100 resumes the heating by the afterheater 73 (step SB17), and then moves the process flow to step SB14. That is, the control unit 100 repeats the stop and resumption of the heating by the afterheater 73 so as to allow the temperature of the afterheater 73 to reach the preset temperature. Further, the control unit 100 allows the display unit 104 to stop the reporting of the information indicating that the temperature of the afterheater 73 has risen the preset temperature.

In contrast, when having determined that the temperature of the afterheater 73 does not fallen below the preset temperature (step SB16: NO), the control unit 100 determines whether or not the temperature of the afterheater 73 is likely to rise above the abnormal temperature on the basis of the temperature of afterheater 73, which is detected by the temperature sensor 102 (step SB18).

For example, the control unit 100 obtains the temperature change of the afterheater 73 on the basis of the monitored temperature of the afterheater 73. Further, the control unit 100 obtains the pair of temperature change appropriate data TD2 and the temperature change inappropriate data FTD2 from the temperature change database 101*a* stored by the storage unit 101; refers to the obtained pair of the two kinds of data; takes into consideration the degrees of the temperature changes of the obtained pair of the two kinds of data; and thereby determines which of the temperature change indicated by the temperature change appropriate data TD2 and the temperature change indicated by the temperature change inappropriate data FTD2 the temperature change of the afterheater 73 is closer to. Further, in the case where the temperature change of the afterheater 73 is closer to the temperature change appropriate data TD2, the control unit 100 determines that the temperature of the afterheater 73 is unlikely to rise above the abnormal temperature. In contrast, in the case where the temperature change of the afterheater 73 is closer to the temperature change inappropriate data FTD2, the control unit 100 determines that the temperature of the afterheater 73 is likely to rise above the abnormal temperature.

When having determined that the monitored temperature of the afterheater 73 is unlikely to rise above the abnormal temperature (step SB18: NO), the control unit 100 returns the process flow to step SB16. In contrast, when having determined that the monitored temperature of the afterheater 73 is likely to rise above the abnormal temperature (step SB18: YES), the control unit 100 determines whether or not the operation mode of the printer 1 is to be moved to the external heater mode (step SB19).

When having determined that the operation mode of the printer 1 is to be moved to the external heater mode (step SB19: YES), the control unit 100 moves the operation mode of the printer 1 to the external heater mode (step SB20).

Since the operation mode of the printer 1 is allowed to be moved to the external heater mode in this way, in the case where the operation of printing is executed, the stop of the operation of the printer 1 is prevented when a user concurrently uses the external heater 9, and thus, the convenience for the user in the case where the external heater 9 is used is increased.

In contrast, when having determined that the operation mode of the printer 1 is not to be moved to the external heater mode (step SB19: NO), the control unit 100 moves the operation mode of the printer 1 to the normal mode (step SB21). In this way, since, when having determined that the movement to the external heater mode is not to be made, on the basis of an operation by a user, the control unit 100 moves the operation mode of the printer 1 to the normal mode, the operation of the printer 1 is caused to be stopped when the temperature of the afterheater 73 has risen above the abnormal temperature, and thus, the safety of the printer 1 is ensured.

Here, the control unit 100 may be configured to, when the temperature of the afterheater 73 has risen above the abnormal temperature and the control unit 100 stops the operation of the printer 1, allow the power supply unit 106 to control the electric power supplied to the external heater 9. For example, when the temperature of the afterheater 73 has risen above the abnormal temperature and the control unit 100 stops the operation of the printer 1, the control unit 100 stops the supply of the electric power to the external heater 9. Upon stop of the operation of the printer 1, the transfer of the medium M is also stopped, and thus, as a result, the external heater 9 continues the heating of the medium M that remains stopped on the support face 63*a* until the start of the operation of the printer 1. Here, when the temperature of the afterheater 73 has risen above the abnormal temperature and the control unit 100 stops the operation of the printer 1, the control unit 100 allows the power supply unit 106 to stop the supply of the electric power to the external heater 9. Thus, the external heater 9 does not continue the heating of the medium M that remains stopped on the support face 63*a* until the start of the operation of the printer 1, and therefore, the degradation of the printing quality is prevented.

Further, the control by the power supply unit 106 on the supply of the electric power to the external heater 9 is not limited to the above case where the temperature of the afterheater 73 has risen above the abnormal temperature and the control unit 100 stops the operation of the printer 1. For example, when the temperature of the afterheater 73 has risen above the abnormal temperature, the control unit 100 may stop the heating by the afterheater 73 and simultaneously therewith may control the supply of the electric power to the external heater 9. With this configuration, excessive heating by the external heater 9 is prevented.

As described above, the printer 1 is a printing apparatus configured to perform printing on the medium M (the medium). The printer 1 includes the temperature sensor 102 configured to detect temperature, and the control unit 100 configured to, when the operation mode of the printer 1 is the calibration mode (the first mode), allow the temperature sensor 102 to detect the temperature of the heat emitted by the external heater 9, and execute processing in relation to the adjustment of the external heater 9 on the basis of the detected temperature.

With this configuration, the processing in relation to the adjustment of the external heater 9 is executed on the basis of the temperature of the heat emitted by the external heater 9, which is detected by the temperature sensor 102, and thus, a user is able to easily adjust the external heater 9 without depending on the feeling, experiences, and the like of the user.

Further, the printer 1 includes the afterheater 73 (the heater) configured to heat the medium M. The temperature sensor 102 is a temperature sensor configured to detect the temperature of the afterheater 73.

Thus, the temperature sensor 102 configured to detect the temperature of the heat emitted by the external heater 9 is a temperature sensor configured to detect the temperature of the afterheater 73 included by the printer 1. For this reason, it is unnecessary to newly install a temperature sensor for detecting the temperature of the heat emitted by the external heater 9. Accordingly, the increase in the cost of the printing system 200 is retained. Further, it is unnecessary to externally install a temperature sensor, and thus, the simplification of the configuration of the printing system 200 is achieved.

Further, the printer 1 includes the display unit 104 (the reporting unit). The control unit 100 allows the display unit 104 to report information indicating whether or not the temperature of the heat emitted by the external heater 9 is within an acceptable range, on the basis of the temperature detected by the temperature sensor 102. For example, the display unit 104 reports the information indicating that the temperature of the heat emitted by the external heater 9 is not within an acceptable range by performing lighting-on of one of the LEDs in accordance with a predetermined specification. Further, for example, the display unit 104 reports the information indicating that the temperature of the heat emitted by the external heater 9 is within the acceptable range by performing lighting-off of the LED in accordance with the predetermined specification.

With this configuration, information indicating whether or not the temperature of the heat emitted by the external heater 9 is within an acceptable range is reported by the reporting unit, and thus, a user is able to recognize whether or not the temperature of the heat emitted by the external heater 9 is within an acceptable range. Thus, the convenience for the user when the external heater 9 is concurrently used is increased.

Further, the printer 1 includes the display unit 104 (the reporting unit) configured to perform issuing of an instruction in relation to the adjustment of the external heater 9. The control unit 100 allows the display unit 104 to perform issuing of an instruction for instructing at least any of the adjustment of the position of the installation of the external heater 9 and the adjustment of the output of the external heater 9, on the basis of the temperature detected by the temperature sensor 102.

With this configuration, the display unit 104 issues an instruction for instructing at least any of the adjustment of the position of the installation of the external heater 9 and the adjustment of the output of the external heater 9, and thus, a user is able to easily adjust the external heater 9 without depending on the feeling, experiences, and the like of the user.

Further, based on the temperature having been detected by the temperature sensor 102, when the temperature of the afterheater 73 has risen above the abnormal temperature (the predetermined threshold value), the control unit 100 causes the operation of the printer 1 to be stopped.

With this configuration, when the temperature of the afterheater 73 included in the printer 1 has risen above the abnormal temperature, the operation of the printer 1 is caused to stop, and thus, the safety of the printer 1 is ensured.

Further, the control unit 100 waits for a reception of an instruction indicating whether or not the operation mode of the printer 1 is to be moved to the external heater mode (the second mode) on the basis of the temperature detected by the temperature sensor 102. Upon reception of an instruction for instructing the movement of the operation mode of the printer 1 to the external heater mode, the control unit 100 moves the operation mode of the printer 1 to the external heater mode that does not cause the operation of the printer 1 to be stopped even when the temperature of the afterheater 73 has risen above the abnormal temperature.

With this configuration, when an instruction for instructing the movement to the external heater mode has been received, the operation of the printer 1 is not caused to be stopped even when the temperature of the afterheater 73 included in the printer 1 has risen above the abnormal temperature. Thus, even when printing is performed while the external heater 9 is concurrently used, the stop of the operation of the printer 1 is prevented, and the convenience for a user when the external heater 9 is concurrently used is increased.

Further, the printer 1 includes the power supply unit 106 configured to supply electric power to the external heater 9. The control unit 100 controls the electric power supplied by the power supply unit 106, on the basis of the temperature detected by the temperature sensor 102.

With this configuration, the electric power supplied by the power supply unit 106 is controlled on the basis of the temperature detected by the temperature sensor 102, and thus, the control of the output of the external heater 9 based on the temperature detected by the temperature sensor 102 is achieved. Thus, excessive heating by the external heater 9 and the influence of the heating by the external heater 9 on the printer 1 are prevented.

MODIFICATION EXAMPLE

Next, a modification example of the printing system 200 will be described.

Figure 8:
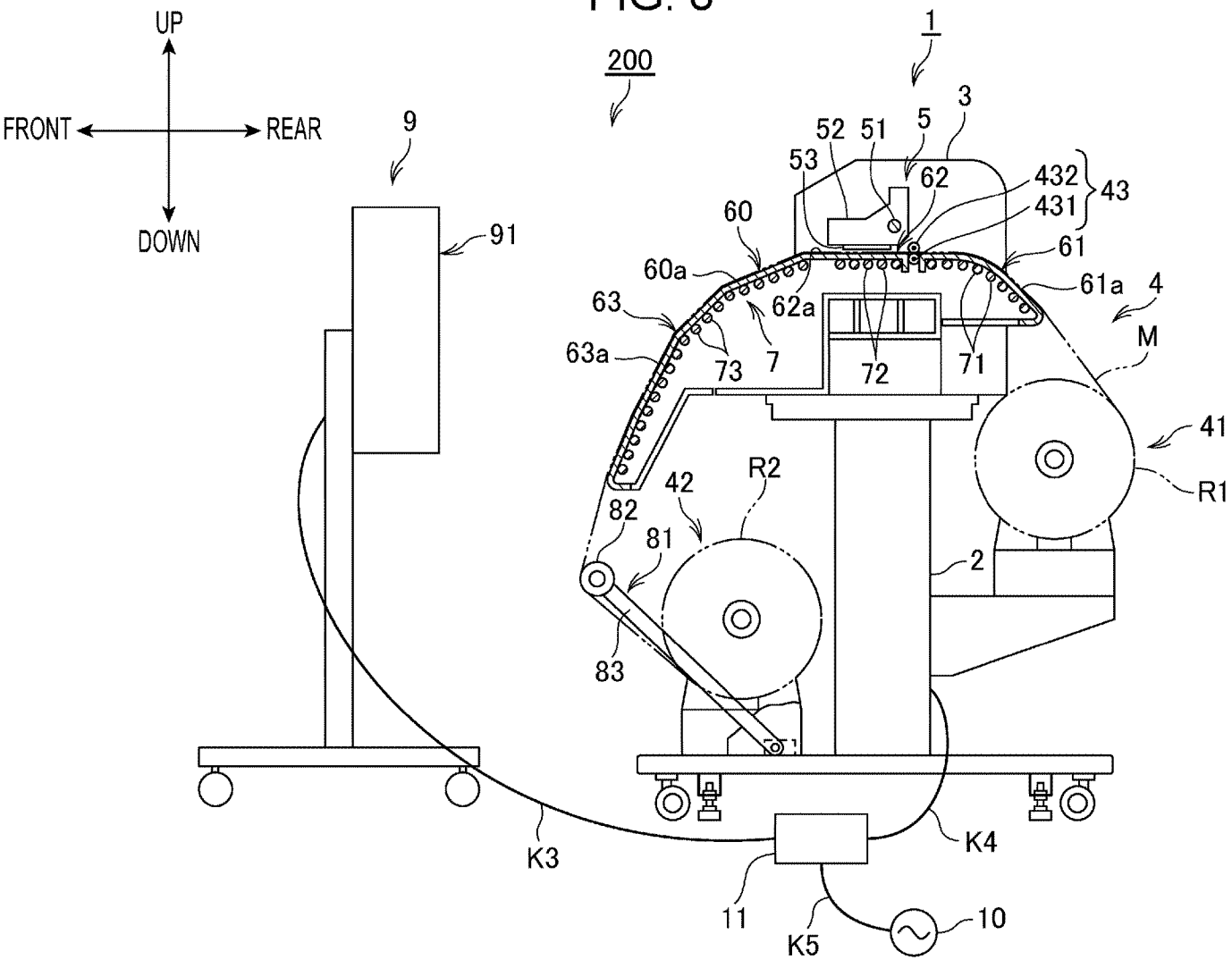
FIG. 8 is a diagram illustrating a configuration of a printing system in a modification example.

FIG. 8 is a diagram illustrating a configuration of the printing system 200 in this modification example.

In the description below, constituent elements similar to constituent elements of the printing system 200 shown in FIG. 1 are denoted by the same reference signs as those of the constituent elements of the printing system 200 shown in FIG. 1, and thereby will be omitted from detailed description.

As obviously understood from the comparison of the printing system 200 shown in FIG. 8 with the printing system 200 shown in FIG. 1, there is a difference in a connection configuration in relation to the supply of electric power for the printer 1 and the external heater 9.

As shown in FIG. 8, the printer 1 is connected to a switch circuit 11 via a cable K4. Further, the external heater 9 is connected to the switch circuit 11 via a cable K3. The switch circuit 11 is a circuit capable of at least turning on/off of the supply of electric power to the external heater 9, and is connected to the commercial alternative-current power source 10 via a cable K5.

The printer 1 is supplied with electric power from the commercial alternative-current power source 10 via the cable K5, the switch circuit 11, and the cable K4. Here, in the case where the switch circuit 11 is configured to execute a rectification process, a smoothing process, a voltage conversion process, and the like, the printer 1 is supplied with direct-current electric power. Further, when the switch circuit 11 is turned on, the external heater 9 is supplied with electric power from the commercial alternative-current power source 10 via the cable K5, the switch circuit 11, and the cable K3. Here, in the case where the switch circuit 11 is configured to execute a rectification process, a smoothing process, a voltage conversion process, and the like, the external heater 9 is supplied with direct-current electric power.

In the case where the printer 1 is configured to control turning on/off of the switch circuit 11, for the supply of electric power to the external heater 9, the printer 1 is capable of performing control similar to the above-described control for the power supply unit 106.

It should be noted that the aforementioned embodiment absolutely describes one embodiment of the invention, and any modifications and applications thereof can be made within the scope of the invention.

For example, in the aforementioned embodiment, the configuration in which the printer 1 includes the temperature sensor 102 configured to detect temperature of the afterheater 73, and allows the temperature sensor 102 to detect the temperature of the heat emitted by the external heater 9 has been exemplified. For this configuration, however, the temperature sensor 12 is not limited to the temperature sensor installed in the printer 1, but may be a temperature sensor attachably/detachably attached onto the afterheater 73, or may be an externally disposed temperature sensor.

For example, in the aforementioned embodiment, the configuration in which, when the temperature of the heat emitted by the external heater 9, which is detected during a predetermined period, has risen above the target temperature or is likely to rise above the target temperature, information indicating that the temperature of the heat emitted by the external heater 9 is not within an acceptable range is reported has been exemplified. For this configuration, however, a configuration in which, when the temperature of the heat emitted by the external heater 9 has fallen below a predetermined temperature lower than the target temperature, the display unit 104 reports information indicating that the temperature of the heat emitted by the external heater 9 is not within an acceptable range may be employed. That is, the display unit 104 may be configured to, when the external heater 9 is concurrently used, report information indicating that the temperature of the heat emitted by the external heater 9 is too low. With this configuration, when the external heater 9 is concurrently used, a probability that a user is able to recognize that the output of the external heater 9 is too high or too low, and the installation position of the external heater 9 is too distant or too near relative to the printer 1 is increased, and thus, the convenience for the user is further increased in the adjustment of the external heater 9.

Further, in the aforementioned embodiment, the configuration in which the control unit 100 retrieves the pair of the temperature change appropriate data TD1 and the temperature change inappropriate data FTD1 or the pair of the temperature change appropriate data TD2 and the temperature change inappropriate data FTD2 from the temperature change database 101*a* has been exemplified. For this configuration, however, the control unit 100 may retrieve not only one pair of the temperature change appropriate data and the temperature change inappropriate data, but also a plurality of pairs of the temperature change appropriate data and the temperature change inappropriate data. In this case, the control unit 100 determines the presence/absence of necessity of the adjustment of the external heater 9 on the basis of the retrieved pairs of temperature change appropriate data and the temperature change inappropriate data.

Further, for example, in the case where a control method for the aforementioned printer 1 (the control method for a printing apparatus) is implemented using a computer included in the printer 1, the invention can be configured in a form of a program that is executed by the computer in order to implement the control method; a form of a recording medium that records therein the program in a way that enables the computer to read the program; or a form of a transmission medium that transmits the program. As the recording medium, a magnetic recording medium, an optical recording medium, or a semiconductor memory device can be used. Specifically, non-limiting examples of the recording medium include portable types of recording media such a flexible disc, a HDD (Hard Disc Drive), a CD-ROM (Compact Disk Read Only Memory), a DVD (Digital Versatile Disk), a Blu-ray (trademark) Disc, a magneto optical disc, a flash memory, and a card type recording medium, and fixed types of recording media. Further, the recording medium may be a nonvolatile recording device that is an internal storage device included in the printer 1, such as a ROM (Read Only Memory) or a HDD.

Further, for example, the processing units in FIG. 4, and FIGS. 6A and 6B, are units obtained by segmenting the processing of the printer 1 in accordance with main processing contents so as to facilitate the understanding of the processing of the printer 1, and the invention is not limited to the segmentation method for the processing units and the names of the processing units. The processing of the printer 1 may be segmented into a larger number of processing units in accordance with the processing contents. Further, the segmentation may be made such that one processing unit includes a larger number of processes.

Further, each of the function units shown in FIG. 3 is for use in describing the functional configuration thereof, and a specific implementation form of the each function unit is not particularly limited. That is, hardware individually corresponding to each of the function units is not necessarily implemented, and a configuration that allows the functions of a plurality of function units to be implemented by allowing one processor to execute a program is naturally applicable. Further, in the aforementioned embodiment, part of functions implemented using software may be implemented using hardware, or part of functions implemented using hardware may be implemented using software. Additionally, the detailed configuration of each of other portions of the printer 1 can be also changed optionally within the scope not departing from the gist of the invention.

This application claims priority under 35 U.S.C. § 119 to Japanese Patent Application No. 2016-237414, filed Dec. 7, 2016. The entire disclosure of Japanese Patent Application No. 2016-237414 is hereby incorporated herein by reference.

What is claimed is:

1. A printing apparatus for performing printing on a medium, comprising:

a temperature sensor configured to detect temperature;

a control unit configured to, in a case where an operation mode of the printing apparatus is a first mode, allow the temperature sensor to detect temperature of heat emitted by a first heater installed externally to the printer apparatus and configured to heat the medium, and execute processing in relation to an adjustment of the first heater based on the detected temperature; and an instructing unit configured to display an instruction for adjustment of the first heater in response to said processing by the control unit, wherein the instruction includes instruction for adjustment of one or both of the installation position of the first heater or an output of the first heater.

2. The printing apparatus according to claim 1, further comprising a second heater disposed along a transport path of the medium and configured to heat the medium, wherein the temperature sensor is configured to detect temperature of the second heater concurrently with detecting the temperature of heat emitted by the first heater.

3. The printing apparatus according to claim 2, wherein, based on the temperature detected by the temperature sensor, when the temperature of the sensor has risen above a predetermined threshold value, the control unit causes a printing operation of the printing apparatus to be stopped.

4. The printing apparatus according to claim 2, wherein the second heater is disposed downstream of a printer head and is configured to heat the medium after printing is performed.

5. The control method according to claim 4, further comprising, based on the temperature detected by the temperature sensor, causing a printing operation of the printing apparatus to be stopped when the temperature of the sensor has risen above a predetermined threshold value.

6. The control method according to claim 5, further comprising:

waiting for a reception of an instruction indicating whether or not the operation mode of the printing apparatus is to be moved to a second mode based on the temperature detected by the temperature sensor, the second mode being a mode in which, even when the temperature of the heater has risen above the predetermined threshold value, the operation of the printing apparatus is not caused to be stopped; and moving the operation mode of the printing apparatus to the second mode based on the instruction.

7. The printing apparatus according to claim 1, further comprising a reporting unit configured to report information, wherein, based on the temperature detected by the temperature sensor, the control unit is configured to cause the reporting unit to report information indicating whether or not the temperature of the heat emitted by the first heater is within an acceptable range.

8. The printing apparatus according to claim 1, further comprising a power supply unit configured to supply electric power to the first heater, wherein the control unit is configured to control the electric power supplied by the power supply unit based on the temperature detected by the temperature sensor.

9. A printing apparatus for performing printing on a medium, comprising:

a temperature sensor configured to detect temperature; and a control unit configured to, in a case where an operation mode of the printing apparatus is a first mode, allow the temperature sensor to detect temperature of heat emitted by a first external heater, and execute processing in relation to an adjustment of the external heater based on the detected temperature, the external heater being externally installed and configured to heat the medium; and a second heater configured to heat the medium;

wherein the temperature sensor is configured to detect temperature of the second heater concurrently with detecting the temperature of heat emitted by the first heater;

wherein, based on the temperature detected by the temperature sensor, when the temperature of the sensor has risen above a predetermined threshold value, the control unit causes operation of the printing apparatus to be stopped;

wherein the control unit waits for a reception of an instruction indicating whether or not the operation mode of the printing apparatus is to be moved to a second mode based on the temperature detected by the temperature sensor, the second mode being a mode in which, even when the temperature of the heater has risen above the predetermined threshold value, the operation of the printing apparatus is not caused to be stopped, and wherein, upon reception of an instruction indicating that the operation mode of the printing apparatus is to be moved to the second mode, the control unit moves the operation mode of the printing apparatus to the second mode.

10. A control method for a printing apparatus for performing printing on a medium, the control method comprising:

in a case where an operation mode of the printing apparatus is a first mode, detecting, by a temperature sensor, temperature of heat emitted by a first heater installed externally to the printing apparatus and configured to heat the medium, and executing processing in relation to an adjustment of the first heater based on the detected temperature; and displaying an instruction for adjustment of the first heater in response to said processing by the control unit, wherein the instruction includes instruction for adjustment of one or both of the installation position of the first heater or an output of the first heater.

11. The control method according to claim 10, wherein a second heater is disposed along a transport path of the medium and configured to heat the medium, wherein the temperature sensor is configured to detect temperature of the second heater concurrently with detecting the temperature of heat emitted by the first heater.

12. The control method according to claim 11, wherein the second heater is disposed downstream of a printer head and is configured to heat the medium after printing is performed.

13. The control method according to claim 10, further comprising reporting, based on the temperature detected by the temperature sensor, information indicating whether or not the temperature of the heat emitted by the first heater is within an acceptable range.

14. The control method according to claim 10, further comprising controlling the electric power supplied to the first heater based on the temperature detected by the temperature sensor.

* * * * *